US008387532B2

(12) United States Patent
O'Dwyer

(10) Patent No.: US 8,387,532 B2
(45) Date of Patent: Mar. 5, 2013

(54) BARREL ASSEMBLY AND PROJECTILE FOR USE WITH THE SAME

(75) Inventor: James Michael O'Dwyer, Richlands (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 12/503,702

(22) Filed: Jul. 15, 2009

(65) Prior Publication Data

US 2009/0282719 A1 Nov. 19, 2009

Related U.S. Application Data

(60) Division of application No. 11/820,857, filed on Jun. 20, 2007, now Pat. No. 7,565,761, which is a continuation of application No. 10/817,667, filed on Apr. 2, 2004, now Pat. No. 7,240,601, which is a division of application No. 10/006,532, filed on Dec. 5, 2001, now Pat. No. 6,715,398, which is a continuation-in-part of application No. 09/670,162, filed on Sep. 26, 2000, now abandoned, which is a division of application No. 09/124,574, filed on Jul. 29, 1998, now Pat. No. 6,123,007, which is a division of application No. 08/525,705, filed as application No. PCT/AU94/00124 on Mar. 14, 1994, now Pat. No. 5,883,329.

(30) Foreign Application Priority Data

Sep. 11, 2001 (AU) ..... PR7575

(51) Int. Cl.
*F42B 5/08* (2006.01)

(52) U.S. Cl. ..... 102/217; 102/438

(58) Field of Classification Search ..... 102/217, 102/438

See application file for complete search history.

(56) References Cited

U.S. PATENT DOCUMENTS

| | | | | |
|---|---|---|---|---|
| 1,376,530 | A | 5/1921 | Greener | |
| 1,746,397 | A | 2/1930 | Johnson | |
| 1,861,522 | A | 6/1932 | Brandt | |
| 2,099,993 | A * | 11/1937 | Tauschek | 89/125 |
| 2,313,030 | A | 3/1943 | Tauschek | |
| 2,790,353 | A | 4/1957 | Bird | |
| 2,835,198 | A | 5/1958 | Brombacher | |
| 2,897,757 | A | 8/1959 | Kullick | |
| 3,023,704 | A | 3/1962 | Dawson et al. | |
| 3,412,681 | A | 11/1968 | Schimeker | |
| 3,450,050 | A | 6/1969 | Robinson | |
| 3,680,485 | A * | 8/1972 | Zaid et al. | 102/506 |
| 3,834,314 | A | 9/1974 | Young | |
| 2,854,231 | A | 12/1974 | Broyles | |
| 3,897,729 | A | 8/1975 | Schimeker | |
| 3,952,658 | A | 4/1976 | Broyles | |
| 4,123,975 | A | 11/1978 | Mohaupt | |
| 6,138,395 | A | 10/2000 | O'Dwyer | |
| 6,223,642 | B1 | 5/2001 | O'Dwyer | |

(Continued)

FOREIGN PATENT DOCUMENTS

FR 774170 12/1934

*Primary Examiner* — Stephen M Johnson

(74) *Attorney, Agent, or Firm* — Amster Rothstein & Ebenstein LLP

(57) ABSTRACT

A barrel assembly for a weapon, said barrel assembly including a barrel; a plurality of projectile assemblies axially disposed in end to end abutting relationship within said barrel for operative sealing engagement with the bore of the barrel, each projectile including a projectile head and an integral cylindrical spacer portion extending axially and rearwardly from said projectile head; discrete propellant charges accommodated within said cylindrical spacer portion for propelling respective projectile assemblies sequentially through the muzzle of the barrel; ignition means for igniting said discrete propellant charges; and control means for selectively and sequentially actuating the ignition means. In one form, each projectile assembly further includes an internal wedging surface, at or adjacent the trailing end of said cylindrical extension which accommodates a tapered nose part of a following projectile, for expanding said trailing end into enhanced sealing engagement with the barrel upon engagement of said wedging surface With said tapered nose part.

15 Claims, 12 Drawing Sheets

U.S. PATENT DOCUMENTS

| | | | |
|---|---|---|---|
| 6,301,819 | B1 | 10/2001 | O'Dwyer |
| 6,343,553 | B1 | 2/2002 | O'Dwyer |
| 6,431,076 | B1 | 8/2002 | O'Dwyer |
| 6,510,643 | B2 | 1/2003 | O'Dwyer |
| 6,782,830 | B1 | 8/2004 | Candland et al. |
| 6,862,996 | B2 | 3/2005 | Key |

* cited by examiner

BARREL ASSEMBLY AND PROJECTILE FOR USE WITH THE SAME

CROSS-REFERENCE TO RELATED APPLICATIONS

This application is a divisional of application Ser. No. 11/820,857, filed Jun. 20, 2007, now U.S. Pat. No. 7,565,761, which is a continuation of application Ser. No. 10/817,667, filed Apr. 2, 2004, now U.S. Pat. No. 7,240,601 issued Jul. 10, 2007, which is a divisional of application Ser. No. 10/006,532, filed Dec. 5, 2001, now U.S. Pat. No. 6,715,398 issued Apr. 6, 2004, which is a continuation-in-part of application Ser. No. 09/670,162 filed Sep. 26, 2000 now abandoned, which is a divisional of application Ser. No. 09/124,574 filed Jul. 29, 1998, now U.S. Pat. No. 6,123,007 issued Sep. 26, 2000, which itself is a divisional of application Ser. No. 08/525,705 filed Sep. 12, 1995, filed as application No. PCT/AU94/00124 on Mar. 14, 1994, now U.S. Pat. No. 5,883,329 issued Mar. 16, 1999, the contents all of which are incorporated herein by reference.

BACKGROUND OF THE INVENTION

The invention relates to firearms.

The invention has utility as an automatic, high rate of fire, firearm whereby it may be used for example, as a close-in ship-board defense against bombs, missiles or attack aircraft for launching large numbers of projectiles within a short period of time. The invention also has utility in hand guns such as a rapid fire pistol or rifle which may be disposable.

Currently, most firearms use cartridge ammunition which is mechanically fed to a barrel. Such firearms have numerous moving parts, tend to be heavy and complex, may jamb or be unreliable, and require elaborate delivery and loading systems to support the rate of fire. The rate of fire of automatic firearms of this type is limited by the time required to load the cartridge, seal the barrel, unseal the barrel and eject the empty case.

More recently, firearms have begun to utilise caseless ammunition which obviates the need to eject an empty case subsequent to firing. However, these firearms retain many of the problems of conventional firearms.

SUMMARY OF THE INVENTION

The present invention aims to provide an alternative barrel assembly for a firearms system which will alleviate at least one of the disadvantages of the prior art.

In particular, the present invention aims to provide a barrel assembly including projectiles axially stacked in a barrel, wherein the projectiles are of the type having a head portion and an integral trailing cylindrical portion whereby the projectiles may be expanded into engagement with the barrel.

According to one aspect this invention provides a barrel assembly for firearms, said barrel assembly including:

a barrel;

a plurality of projectile assemblies axially disposed in end to end abutting relationship within said barrel for operative sealing engagement with the bore of the barrel, each projectile assembly including a projectile head and an integral cylindrical spacer portion extending axially and rearwardly from said projectile head;

discrete propellant charges accommodated within said cylindrical spacer portion for propelling respective projectile assemblies sequentially through the muzzle of the barrel;

ignition means for igniting said discrete propellant charges; and control means for selectively and sequentially actuating the ignition means.

The rearward end of the cylindrical spacer portion is preferably adapted to abut the forward or leading end of the subsequent projectile assembly. The cylindrical spacer portion may be expanded into operative sealing contact with said bore of the barrel. Suitably, the interior of the cylindrical spacer portion is structurally reinforced to prevent excessive radial expansion. Desirably, the trailing cylindrical extension of the projectile extends in close proximity with the barrel.

According to a further aspect, this invention provides a barrel assembly for firearms, said barrel assembly including:

a barrel having a muzzle;

a plurality of projectiles axially disposed in end to end abutting relationship within said barrel, each projectile including a projectile head and a trailing cylindrical extension in close proximity with the barrel;

an internal wedging surface, at or adjacent the trailing end of said cylindrical extension which accommodates a tapered nose part of the following projectile, for expanding said trailing end into enhanced sealing engagement with the barrel upon engagement of said wedging surface with said tapered nose part;

discrete propellant charges for propelling respective projectiles sequentially through the muzzle of said barrel;

ignition means disposed externally of the barrel for igniting said discrete propellant charges; and control means for selectively and sequentially actuating said ignition means.

The trailing cylindrical extension may at least partly define a propellant space therein. Alternatively the propellant charges may surround the noses of respective following projectiles externally of the trailing cylindrical extension.

Each projectile may include an internal spacer which extends through the trailing cylindrical extension from the projectile head to abut or cooperate with the inserted projectile head of a following projectile whereby axial compressive loads applied to a stack of projectiles arranged in sealing engagement within a barrel may be resisted through abutting projectiles. Alternatively such loads may be distributed back to the barrel from individual projectiles through their engagement with the barrel.

The spacer may include support for the trailing cylindrical extension which may be a thin cylindrical rear extension of the projectile head. The spacer may be integral with the head and trailing cylindrical extension or it may be formed separately therefrom and from a different material if required.

In such arrangements the projectile head and spacer may be loaded into the barrel and thereafter an axial displacement thereof caused to expand the trailing end and enhance the sealing engagement between the projectiles and the barrel. This axial displacement is suitably caused individually as the projectiles are subsequently loaded into the barrel. The radial expansion into enhanced sealing engagement with the barrel may be limited through engagement between the penetrating nose of a following projectile and the internal spacer assembly.

The ignition means may be electrical, chemical, mechanical or any other conventional primer. Conveniently, the ignition means is electrical and the control means is an electrical control adapted to provide electrical ignition pulse to the respective ignition means. Suitably the control means is configured to enable a user to selectively control the rate, number, and frequency of the pulses to provide a desired firing pattern.

The control means may fire the projectile assemblies singly, in pairs, or in any other combinations.

The projectile assembly may be round, conventionally shaped or dart-like and the fins thereof may be off-set to generate a stabilising spin as the dart is propelled from a barrel which may be a smooth-bored barrel. In addition the barrel assembly may find utility as a removable/replaceable barrel of a rifle or pistol.

Alternatively the barrel assembly constitutes one of a plurality of barrel assemblies and the control means may actuate the ignition means of each of the barrel assemblies in such manner that a sequential plurality of arrays of projectile assemblies are propelled in following relationship. Aiming and firing of the arrays of projectile assemblies may be controlled by a conventional radar fire control system or other known fire control systems. The individual barrel assemblies may be aimed such that the array of projectile assemblies converges at a particular range to give a maximum density of projectile assemblies at that range.

Alternatively, the array of projectile assemblies may diverge to maximise coverage of an area. Thus, the average separation distance at the target between the projectile assemblies in an array can be predetermined and adjusted to suit the nature and range of the target. Of course, the individual barrel assemblies may be fired randomly or independently of the other barrel assemblies.

The propelling charges may be either solid or granular and compression of either may be an undesirable, moreover, movement of the projectile assemblies relative to the barrel may cause misalignment of the ignition means with their respective propellant charges.

It is preferred that the ignition means be disposed at the leading end of the propellant charge so as to minimise possible energy loss in accelerating the front portion of the propellant charge.

In another embodiment, complementary wedging surfaces are disposed on the spacer assembly and projectile head respectively whereby the projectile head is urged into engagement with the bore of the barrel in response to relative axial compression between the spacer means and the projectile head. In such arrangement the projectile head and spacer assembly may be loaded into the barrel and thereafter an axial displacement is caused to ensure good sealing between the projectile head and barrel. Suitably the extension means is urged into engagement with the bore of the barrel.

Preferably, the projectile head defines a tapered aperture at its rearward end into which is received a complementary tapered spigot disposed on the leading end of the spacer assembly, wherein relative axial movement between the projectile head and the complementary tapered spigot causes a radially expanding force to be applied to the projectile head.

The barrel may be non-metallic and the bore of the barrel may include recesses which may fully or partly accommodate the ignition means. In this situation the barrel houses electrical conductors which facilitate electrical communication between the control means and ignition means. This arrangement may be utilised for disposable barrel assemblies which have a limited firing life and the ignition means and control wire or wires therefor can be integrally manufactured with the barrel.

In an alternative arrangement, a barrel assembly includes ignition apertures in the barrel and the ignition means are disposed outside the barrel and adjacent the apertures. The barrel may be surrounded by a non-metallic outer barrel which may include recesses adapted to accommodate the ignition means. The outer barrel may also house electrical conductors which facilitate electrical communication between the control means and ignition means. The outer barrel may be formed as a laminated plastics barrel which may include a printed circuit laminate for the ignition means.

Both of the above arrangements lend themselves to a modular or disposable construction. The barrel assemblies may be adapted for firing as is, or may be adapted for mounting within a housing.

For safety, the barrel assembly may include an arming switch associated with each ignition means which is closed in response to the preceding projectile assembly being discharged. Preferably, the arming switch is closed by biasing means which are normally resisted by the preceding projectile assembly. In a preferred embodiment, the projectile head and spacer assembly each constitute switch contacts which are normally electrically isolated from each other and wherein an electrical circuit between the barrel and spacer body is completed in response to the preceding projectile assembly being discharged. In this arrangement, the barrel, which is in electrical contact with the projectile head, is also in contact with one of the electrodes.

BRIEF DESCRIPTION OF THE DRAWINGS

In order that this invention may be more readily understood and put into practical effect, reference will now be made to the accompanying drawings which illustrate typical embodiments of the invention and wherein.

DESCRIPTION OF THE PREFERRED EMBODIMENTS

Figure 1:
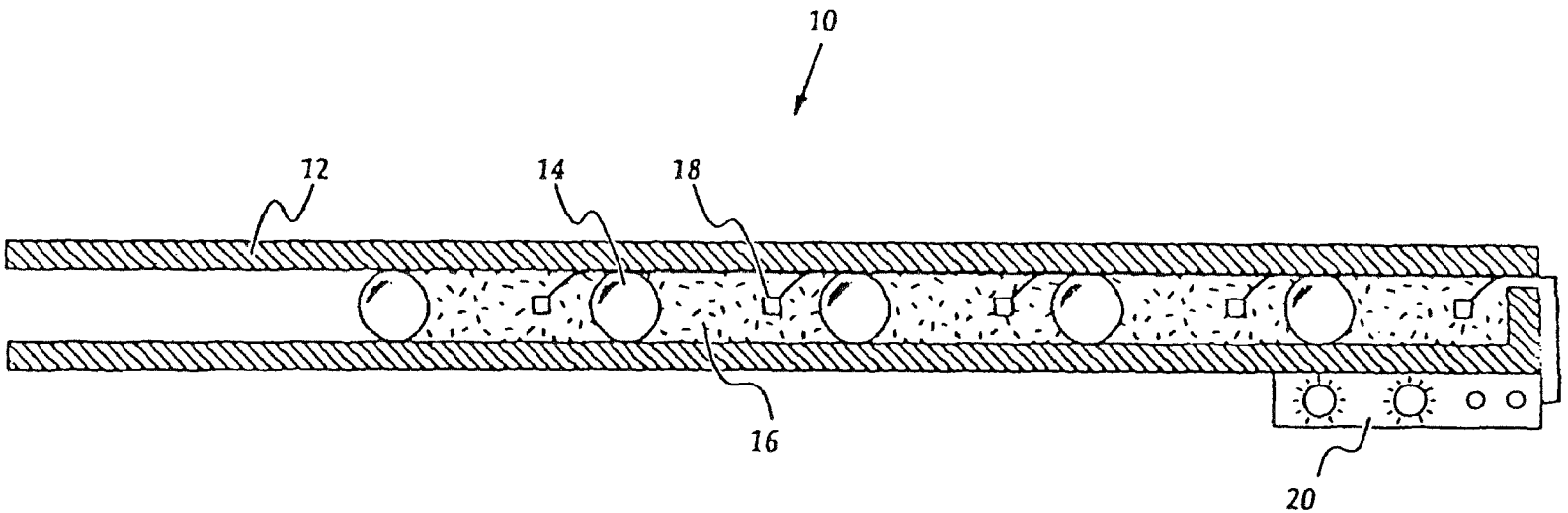
FIG. 1 is a sectional and schematic view of an embodiment of a barrel assembly according to the invention.

Referring to FIG. 1, there is illustrated a barrel assembly 10 including a barrel 12, a plurality of projectile assemblies 14, here of simple spherical form, axially disposed within barrel 12 for operative sealing engagement with the bore of barrel 12, discrete propellant charges 16 disposed between adjacent projectile assemblies 14 for propelling the respective projectile assemblies 14 individually and sequentially through the muzzle of barrel 12, ignition means 18 for igniting discrete propellant charges 16, and control means 20 for selectively and sequentially actuating ignition means 18.

In use, the leading projectile assembly 14 is propelled in response to ignition of the leading propellent charge 16 by the leading ignition means 18. Thereafter the following projectile assemblies are sequentially propelled in like fashion. There is no ammunition delivery system or moving parts, and the firing rate is practically limited only by the time taken for each projectile assembly to exit the barrel.

The control means may have time delay means to control the rapidity of fire and or timing means permitting a selected number of sequential ignitions in response to each manual actuation of the ignition means, such as by squeezing a trigger. A mode switch may be associated with the control means to enable a user to select the form of firing, ie full barrel discharge, short bursts of rapid fire, sequential fire of a selected number of projectiles, single shot firing per actuation etc. Integrated circuit electronic control means are preferably utilised as the control means and may be manufactured as part of the barrel assembly.

Figure 2:
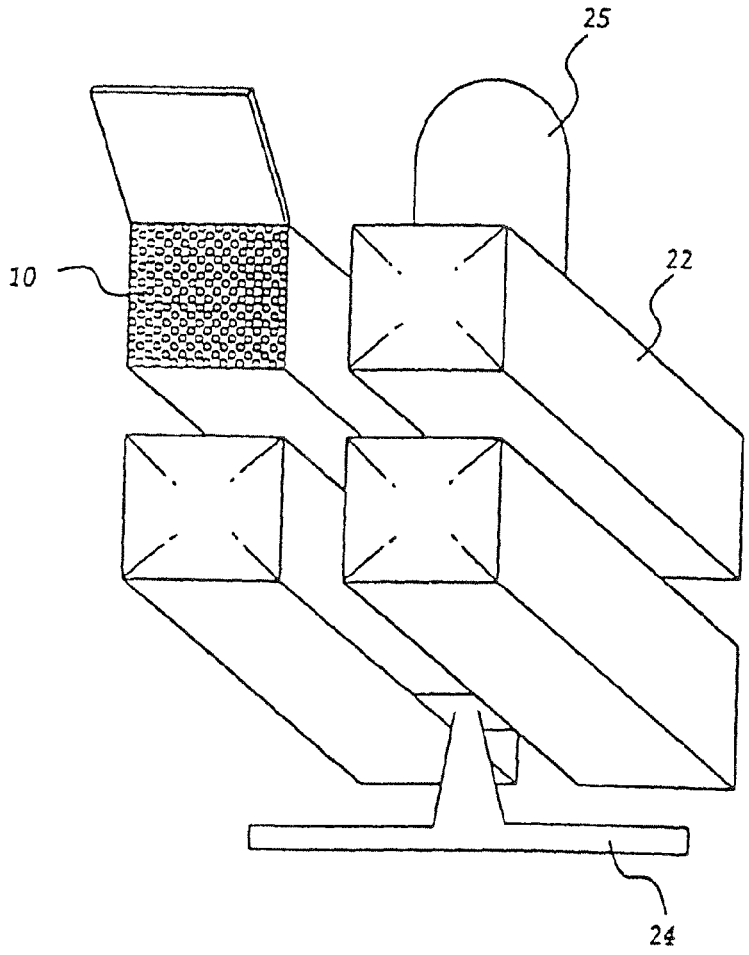
FIG. 2 schematically illustrates the concept of a plurality of barrel assemblies according to the invention being massed in pods.
Figure 3:
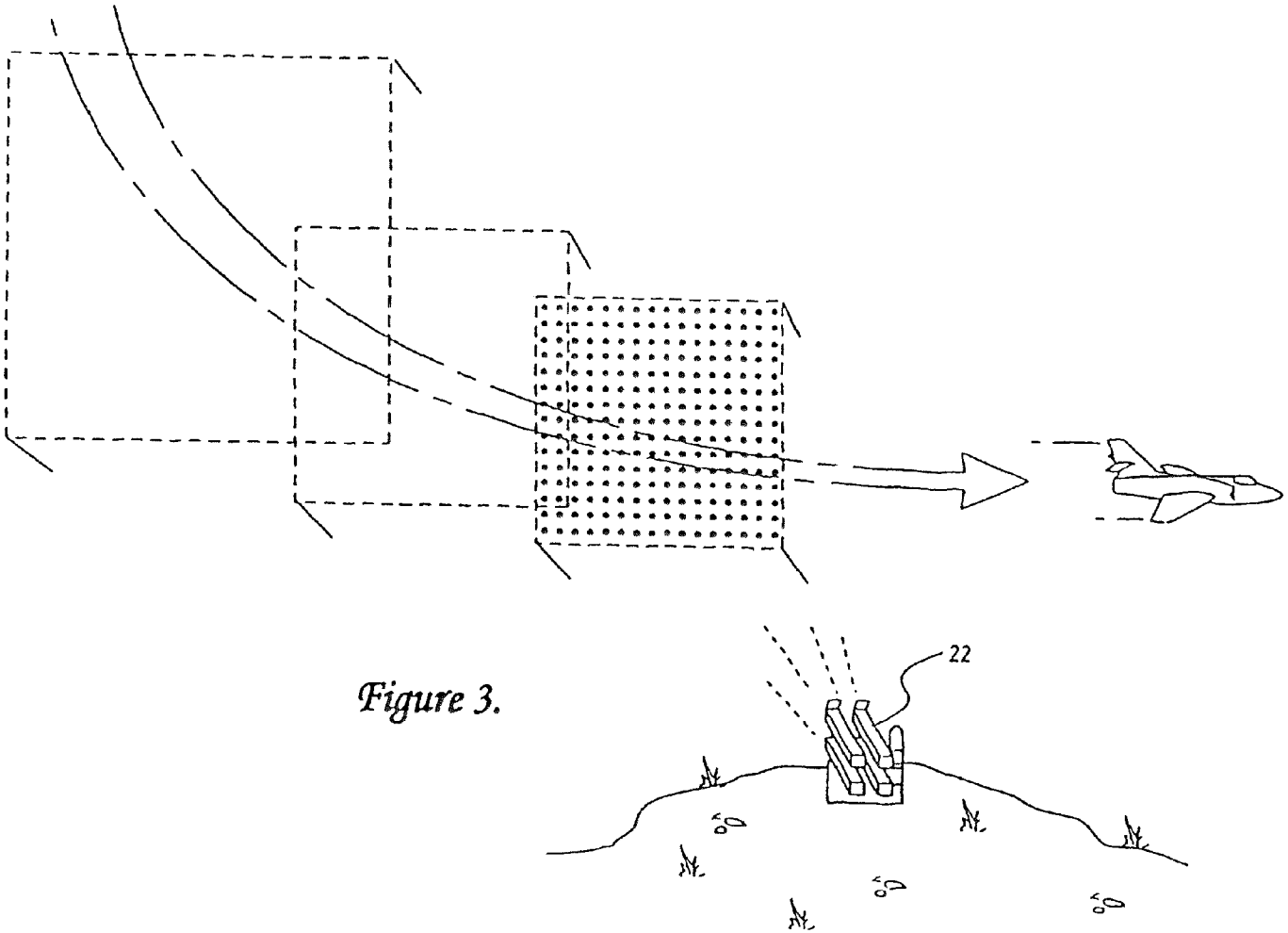
FIG. 3 is a schematic view of arrays of projectile assemblies being fired from the pods of FIG. 2.
Figure 4:
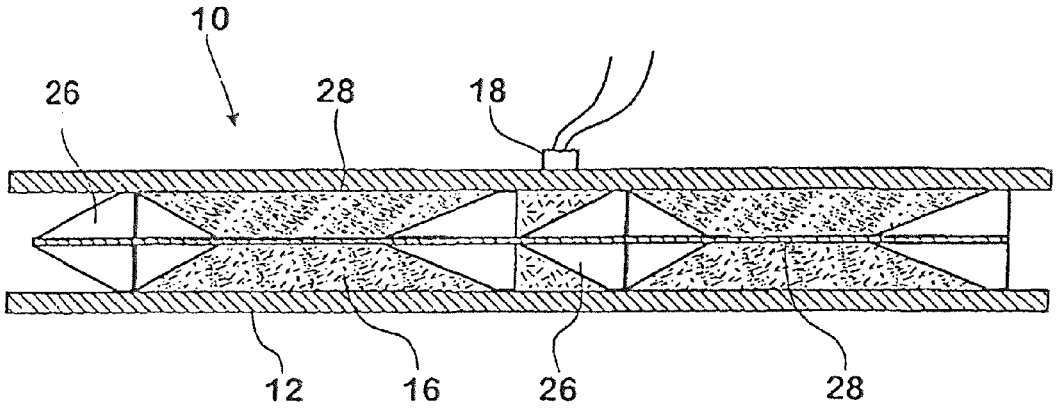
FIG. 4 is a sectional and schematic view of an embodiment of a barrel assembly according to the invention wherein the projectile assembly is in the form of a dart.

Referring to FIG. 2, the barrel assembly constitutes one of a plurality of barrel assemblies and the control means actuates the ignition means of each of the barrel assemblies in such manner that a sequential plurality of arrays of projectile assemblies are propelled in following relationship as shown in FIG. 3. The plurality of barrel assemblies forms a pod 22 and a plurality of pods are mounted on a trainable mount 24. The aiming and firing of the barrel assemblies is controlled by a radar fire control system 25 or other conventional system.

In one form, each barrel is 2.25 metres long and has an outside diameter of 20 mm. The combined propelling charge/projectile assembly length is 50 mm. Leaving 0.25 metres of the barrel free, 40 projectile assemblies together with their associated propellent charges can be pre-loaded into the barrel. The pod has a cross-sectional dimension of 0.75 metres by 0.75 metres for example and therefore accommodates approximately 1200 barrel assemblies. Thus, a pod can be pre-loaded with 48000 projectile assemblies.

This enables significant fire-power to be associated with a relatively small weapon and a very high discharge rate to be achieved, bearing in mind the firing rate of each individual barrel assembly may be significantly in excess of the rate achievable by conventional automatic firearms. The barrel assemblies may be formed as a relatively lightweight honeycomb structure which will be very stiff and if desired the barrels may be arranged to focus at a point relatively close to the weapon with a view to counteracting the spreading tendencies produced by the expansion of the hot explosion gases radiating in an outwards direction. Alternatively a box-like baffle could be used to prevent the immediate outward spread of the gases. This baffle may be slidably supported about the outer barrel section for extension past the end of the barrels during firing. A further manner of alleviating this perceived effect would be to slightly stagger the firing of the projectiles.

Referring to the embodiments of FIGS. 4 to 10, projectile assemblies 14 are disposed in axial abutting relationship to form a compression resistant column. Axially compressive loads are created by the pressures generated in the barrel by the propulsion of preceding projectile assemblies. Compression can result in an alteration of the burn rate of a propelling charge, misalignment of ignition means with respective propelling charges or even premature ignition of propelling charge.

Each projectile assembly 14 includes a projectile head 26 and means for defining a propellant space in the form of spacer assembly 28 which extends axially and rearwardly from projectile head 26 and abuts an adjacent projectile assembly 14.

In one form, the projectile head 26 is formed from a heavy malleable material such as lead to facilitate operative sealing with barrel 12, and spacer assembly 28 is formed of a rigid material such as steel.

Figure 5:
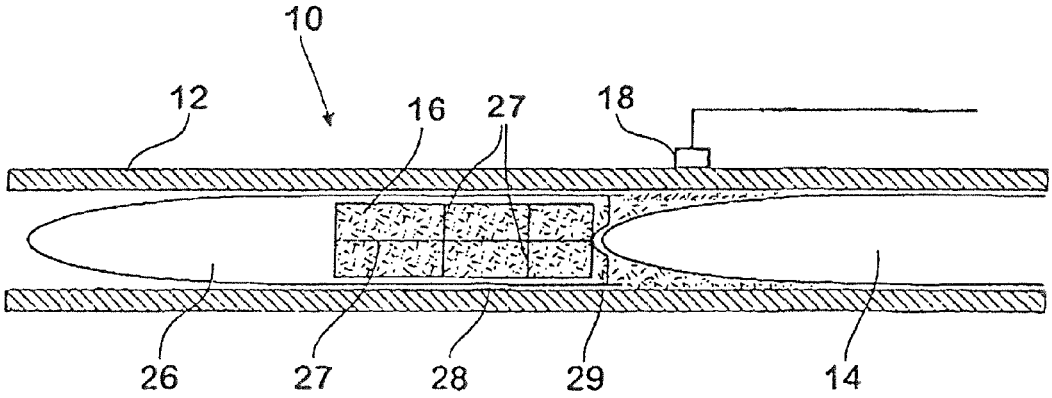
FIG. 5 is a sectional and schematic view of another embodiment of a barrel assembly according to the invention wherein the projectile has a trailing cylindrical portion.

In the embodiment of FIG. 5, the spacer assembly 28 takes the form of a cylinder axially extending from projectile head 26. The interior of the cylinder accommodates propellent charge 16 and is structurally reinforced 27 to prevent excessive radial expansion. The end 29 of the cylinder is adapted to abut the leading end of the subsequent projectile assembly 14. Further embodiments employing projectile assemblies formed with an integral cylindrical extension are described below in relation to FIGS. 14 to 17.

Figure 6:
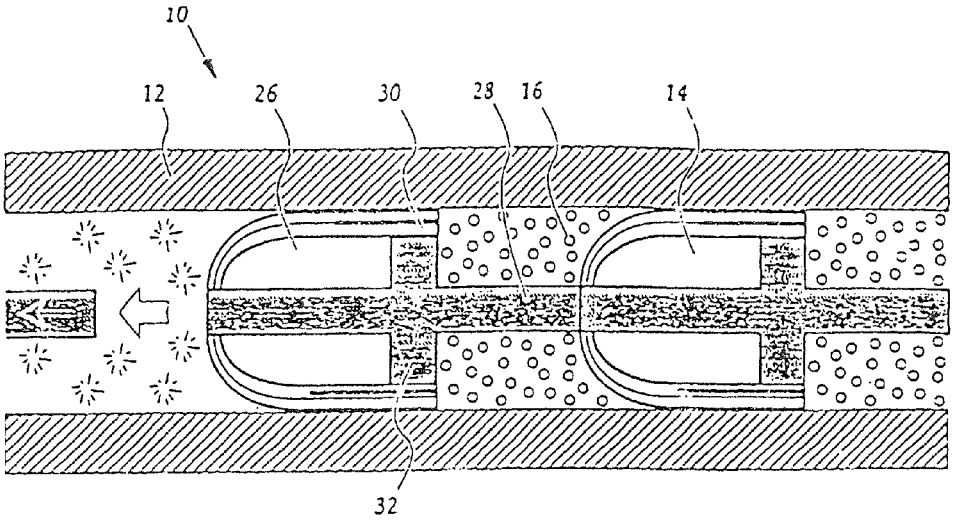
FIG. 6 is a sectional and schematic view of another embodiment of a barrel assembly according to the invention.
Figure 7:
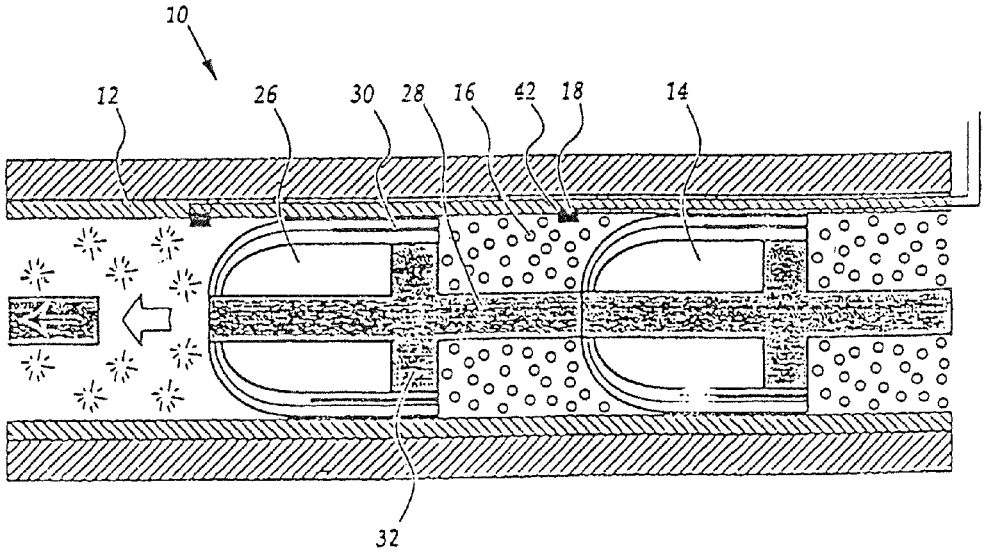
FIG. 7 is a sectional and schematic view of another embodiment of a barrel assembly according to the invention.

Referring to the embodiments of FIGS. 6 and 7, spacer assembly 28 extends through projectile head 26 to the leading end of projectile head 26 whereby compressive loads are transmitted directly between adjacent spacer assemblies 28. Spacer assembly 28 supports a thin cylindrical rear portion 30 of projectile head 26 in operative sealing contact with the bore of barrel 12. Specifically, spacer assembly 28, includes a radially outwardly extending collar flange 32 which supports thin cylindrical rear portion 30 of projectile head 26 in operative sealing contact with the bore of barrel 12.

Figure 9:
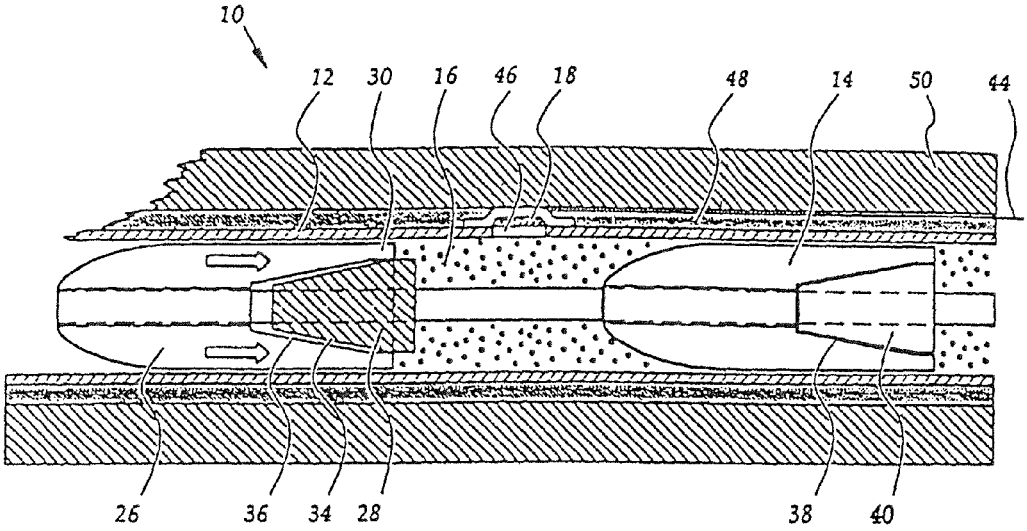
FIG. 9 is a sectional and schematic view of another embodiment of a barrel assembly according to the invention.
Figure 10:
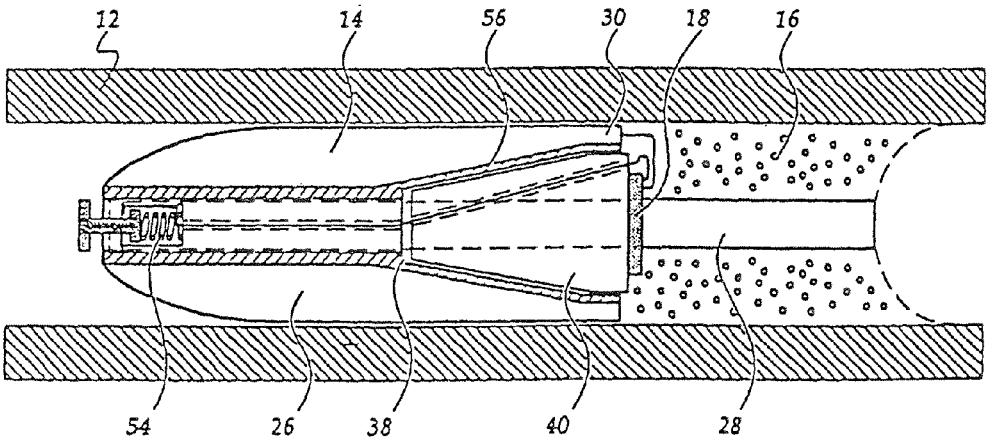
FIG. 10 is a sectional and schematic view of another embodiment of a barrel assembly according to the invention.

Referring to the embodiments of FIGS. 9 and 10, complementary wedging surfaces 34, 36 are disposed on spacer assembly 28 and projectile head 26 respectively whereby thin cylindrical rear portion 30 of projectile head 26 is urged into engagement with the bore of barrel 12 in response to an axially compressive load being applied to projectile assembly 14. Projectile head 26 defines a tapered aperture 38 at its rearward end into which is received a complementary tapered spigot 40 disposed on the leading end of spacer assembly 28. Relative axial movement between tapered aperture 38 and complementary tapered spigot 40 causes a radially expanding force to be applied to thin cylindrical rear portion 30 of projectile head 26.

In the embodiment of FIG. 7, barrel 12 is non-metallic and the bore of the barrel includes recesses 42 which at least partly accommodate ignition means 18. Barrel 12 may be formed of kevlar, carbon fibre, glass reinforced polymer or the like. Thus, the barrel assembly may be lightweight and disposable. Barrel 12 houses electrical conductors 44 which facilitate electrical communication between the control means and ignition means.

Figure 8:
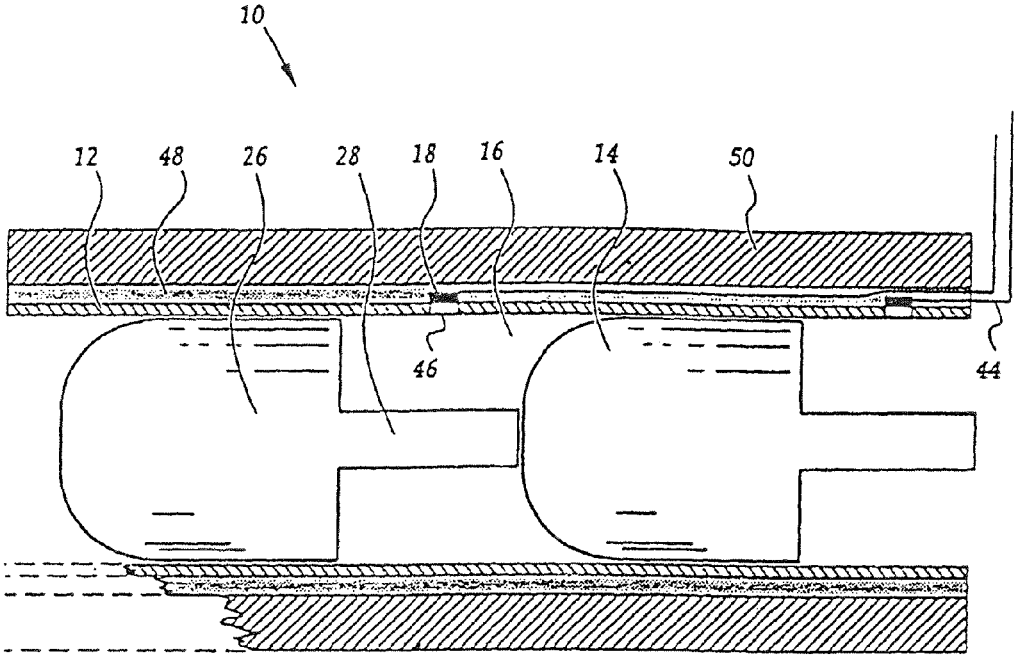
FIG. 8 is a sectional and schematic view of another embodiment of a barrel assembly according to the invention.

In the embodiments of FIGS. 8 and 9, barrel 12 includes ignition apertures 46 and ignition means 18 are disposed outside the barrel and adjacent the apertures. Barrel 12 is surrounded by a non-metallic outer barrel 48, the bore of the outer barrel including recesses adapted to at least partly accommodate the ignition means. The barrel assembly may be slidably received in sheath 50. Outer barrel 48 houses electrical conductors 44 which facilitate electrical communication between the control means and ignition means 18.

Referring to FIG. 10, arming switch 52 associated with ignition means 18 is closed in response to the preceding projectile assembly being discharged. Specifically, arming switch is closed by biasing means 54 once the preceding projectile assembly has been propelled. Projectile head 26 and spacer assembly 28 each constitute switch contacts which are normally electrically isolated from each other by insulating layer 56. An electrical circuit between barrel 12 and spacer assembly 28 is completed when arming switch 52 closes in response to the preceding projectile assembly being discharged. The ignition means 18 is thus armed only when the preceding projectile assembly has been discharged.

Figure 11:
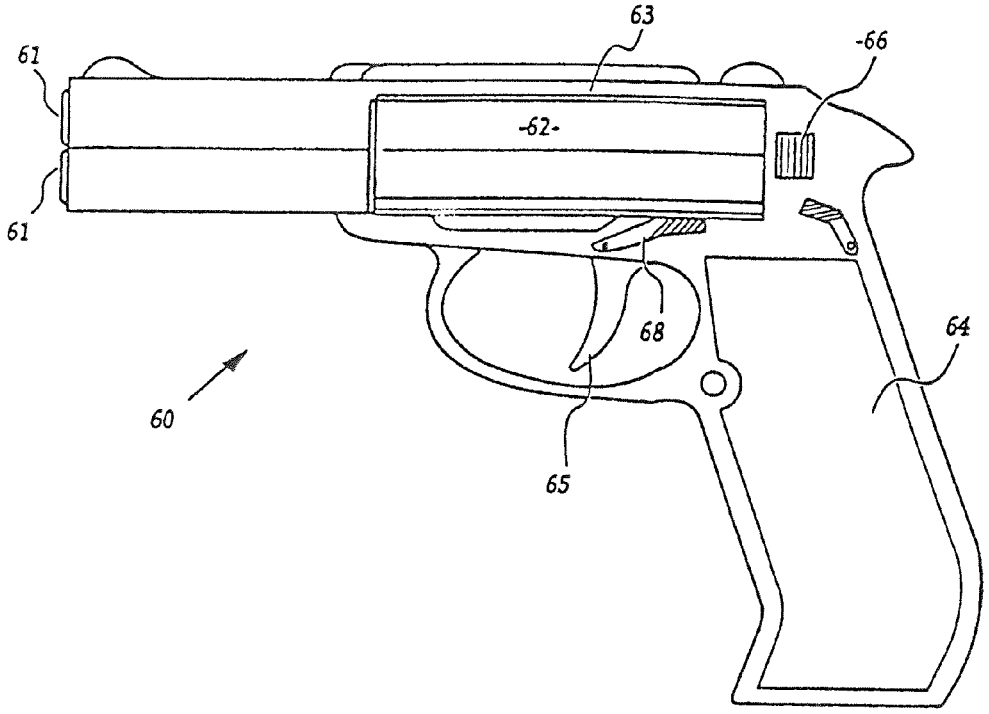
FIG. 11 is a diagrammatic representation of a pistol made in accordance with the present invention.

A four barrel hand gun 60 is illustrated in FIG. 11. The barrels of the four barrel set 61, are arranged in a square formation, and are fed by a matching replaceable four barrel magazine block 62 which slots into a cutout 63 at the base of the barrel set 61. The barrel set 61 is formed integrally with the handgrip 64 which contains the electronic controls for the ignition means.

The four barrel magazine block 62 is loaded with 5 rounds per barrel, which number may of course be varied depending on the size of the block and the size of the round. In this embodiment the magazine block 62 contains twenty rounds.

A variable fire rate and pattern switch 66, is provided for selectively controlling the electronic ignition circuits within the magazine block 62 which connect electrically with the circuits in the hand gun via contacts which meet when the magazine block 62 is slid into position. The switch 66 may be adjusted for electronic control to enable a user to fire individual rounds with each action of the trigger 65, up to four rounds simultaneously, or all rounds automatically on all barrels. A safety catch 68 may also be provided for electrically disabling the weapon. Preferably the cartridges are disposable and may be provided in different formats so that a user may select and/or quickly change the type of rounds to be fired.

Figure 12:
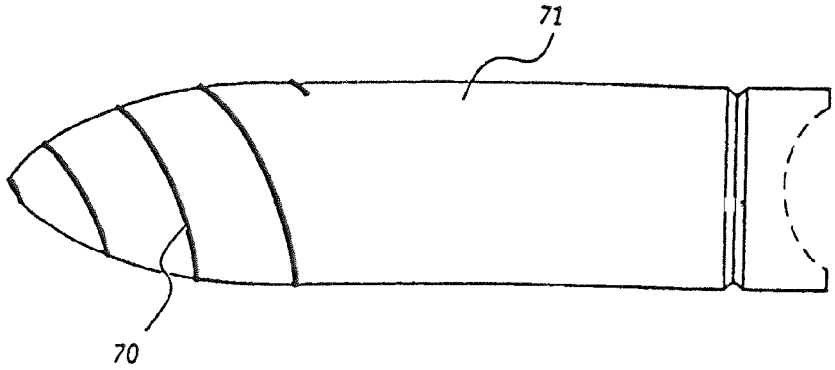
FIGS. 12 and 13 illustrate an alternate form of projectile.
Figure 13:
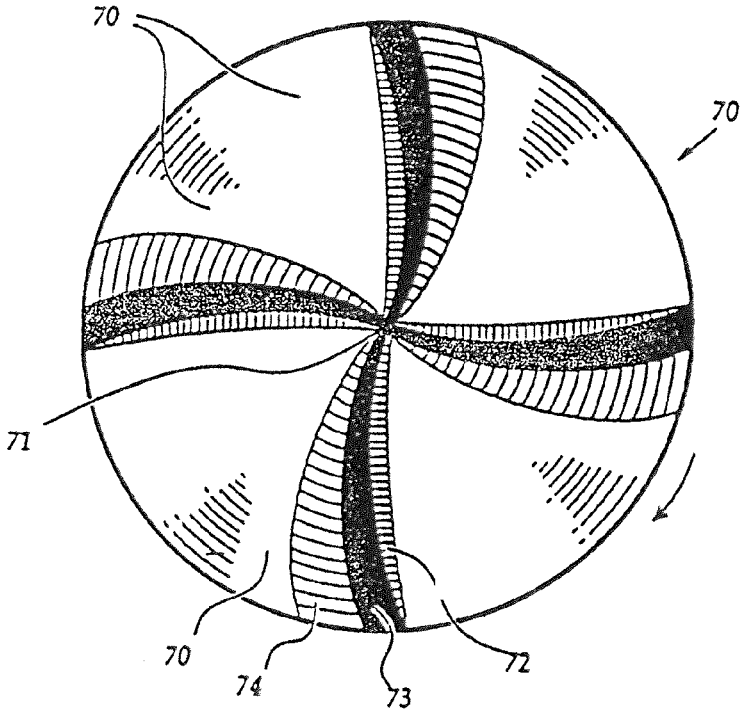

The projectiles for use with the above described embodiments may be provided with external flights or spiral ridges as illustrated in FIGS. 12 and 13. The ridges 70 are provided on the nose of the projectile to impart spin during flight. In the form illustrated a 7.62 mm bullet 71 has four spiralling ridges 70 radiating from the nose of the bullet. The ridges are of an average height of 1.5 mm and extend the length of the nose of the bullet, but not along the side of the bullet. The pitch is suitably formed as to provide a single revolution of the bullet about its longitudinal axis for every meter traveled.

Of course two or more spiralling ridges, spaced evenly around the bullet nose may be utilised if desired. Furthermore the height of the ridges, the length of the ridges, the pitch or degree of spiralling, the geometric curve form of the spiral, may be varied to suit the desired flight characteristics. The ridges may also extend along the side of the bullet. The cross section profile of the spiral ridges may be relatively flat, or steep according to the intended use of the ammunition, and the desired degree of reaction to the airflow.

As illustrated in FIG. 13, the ridges 70 may have a steep leading face 72, which offers resistance to the airflow over the bullet, and causes the bullet to rotate, a flat top portion 73 and trailing faces 74 which slope gently to the surface of the bullet.

Such ammunition may also be used in rifled barrel weapons to advantage. Also as the spirals on the bullet would assist in producing the spin during firing, the normal pressure applied by the edge of the rifling lands against the soft metal of the bullet would be reduced. Therefore the bullet would not require the rifling to cut as long a track along the side of the bullet. Rather, the small expanding band of the Minie gas sealing system would then be adequate to assist with spin acceleration. On impact with soft targets, the spiral bullet of the present invention would tend to react to the increased pressure on the ridges by maintaining a high rate of twist, as it progresses through the target material.

Figure 15:
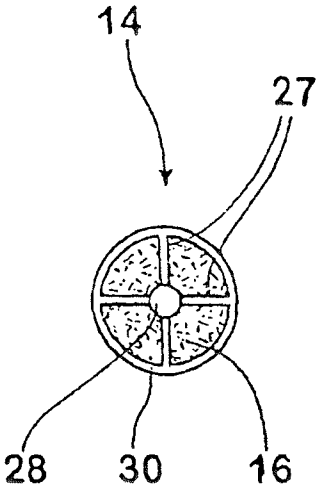
FIGS. 14 and 15 are sectional side and end views of another embodiment of a projectile of the type generally illustrated in FIG. 5.
Figure 14:
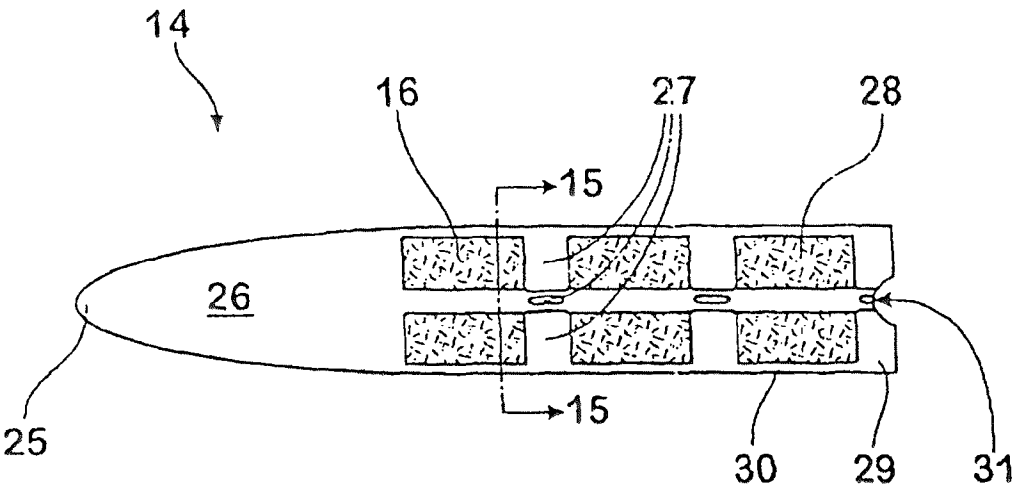
Figure 16:
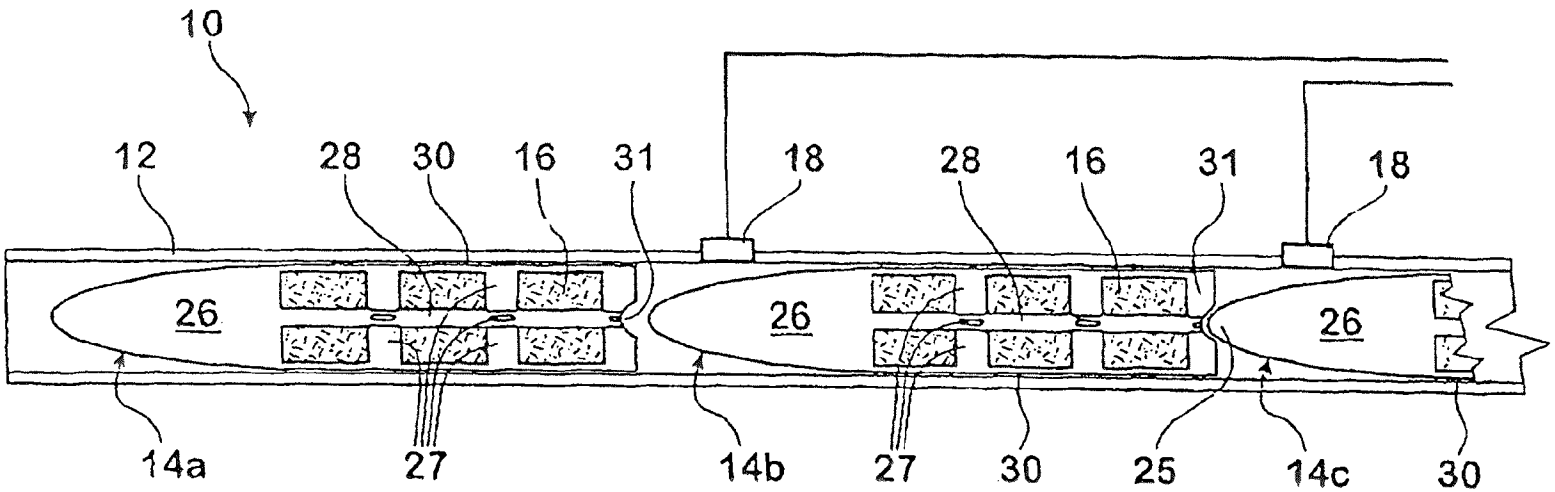
FIG. 16 illustrates a barrel assembly employing projectiles of the type illustrated in FIGS. 14 and 15.

The projectile 14 illustrated in FIGS. 14 and 15 includes a thin cylindrical extension 30 integral with the projectile head 26 and extending axially therefrom in close conformity with the bore of the barrel 12, as shown in the barrel assembly 10 in FIG. 16. Internal reinforcement is provided for the trailing cylindrical extension 30. The reinforcement includes webs 27 extending radially from a central spine 28 as seen in cross-section in FIG. 15, which spine extends axially from the head 26. This reinforcement prevents excessive radial expansion of the trailing cylindrical extension 30 occurring during firing.

The trailing end of the projectile 14 has a central recess 31 formed in the end of the spine 28 and associated radial webs 27 to accommodate the nose 25 of a following projectile 14*b*. The projectile head 26 and associated spine 28 enables a continuous compression resistant column to be formed when the projectiles 14 are stacked in abutting relationship in the barrel 12.

In the barrel assembly 10 illustrated in FIG. 16, a leading projectile 14*a* is shown slightly separated from an adjacent following projectile 14*b* and partly advanced through the barrel 11, while the rearmost projectile 14*c* nest in end to end abutting relationship to form an axial stack of projectiles 14 within the barrel 12.

The cylindrical extension 30 also accommodates the propellant charge 16 which is selectively ignitable by an electronically controlled ignition means 18, which ignition means may be internal or external of the barrel. The radial webs 27 are streamlined to assist gas flow thereabout for discharge through the open rear end 29 of the cylindrical extension 30.

Figure 17:
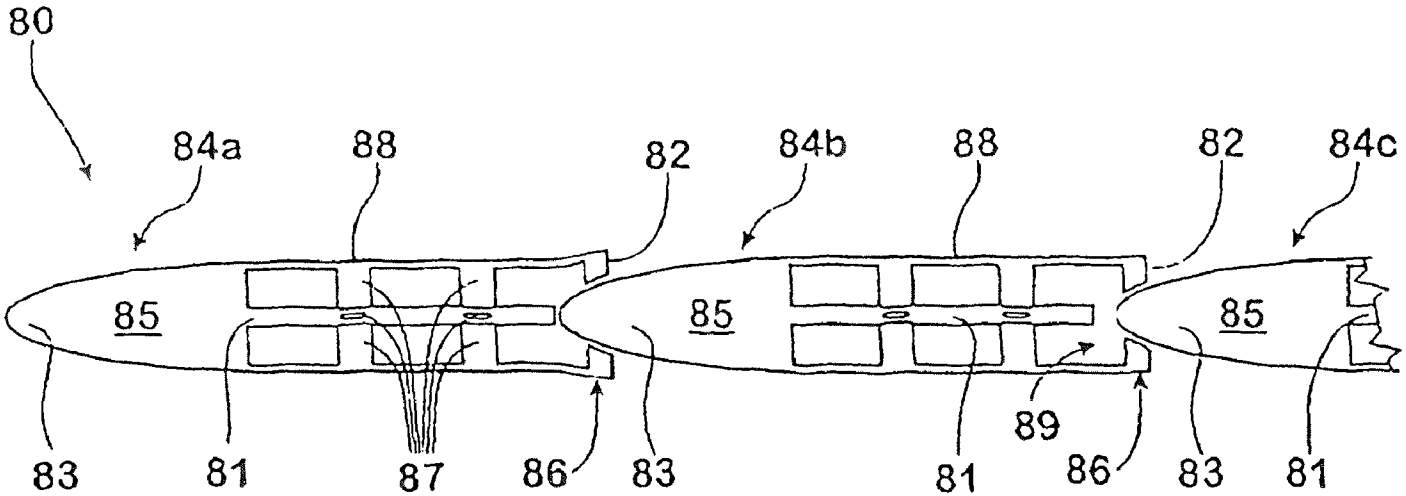
FIG. 17 illustrates a barrel assembly of a further embodiment of the invention.

An axial stack of projectiles 80 of a further embodiment of the invention as illustrated in FIG. 17, are similar to the projectiles 14 of FIG. 16. However in this form, the central spine 81 which extends rearward from the projectile head 85 terminates short of the rearmost radial webs 82. The rearmost webs are profiled to closely accommodate the rearwardly diverging nose portion 83 of a following projectile. Further radial webs 87 extend from the spine 81 and provide support for the intermediate portion of the thin cylindrical extension 88.

In one arrangement, a leading projectile 84*a* may be set into position in a supporting barrel (not illustrated) by forcing its rearmost webs 82 over the nose portion 83 of a following projectile 84*b*. This forcing action causes a slight radial expansion (shown in exaggerated form) of the trailing end 86 of the projectile and assists the projectiles 84 to seal in a supporting barrel.

The expansion may be limited by terminating the spine 81 a set distance forward of the rearmost webs 82 to form a stop for the penetrating nose 83 of the following projectile 84*b*. Alternatively the amount of penetration may be set by applying a predetermined impact to the projectile being loaded to achieve the desired radial engagement of the trailing end 86 of the leading projectile 84*a* with the supporting barrel (not shown). Suitably this radial engagement is achieved before the nose 83 of the following projectile abuts the spine 81, as denoted by 89.

The radial engagement may be increased in use due to gas pressure applied to a following projectile. The gas pressure is generated upon firing the propellant charge associated with the leading projectile. That is, the trailing end 86 of a leading projectile may be forced further over of the nose portion 83 of its respective following projectile until the leading spine 81 abuts the following nose 83.

A rear collar or thickening of the cylindrical extension 88 may be added to or substituted for the radial webs 87 if desired, or the configuration of four radial webs (as illustrated) may be replaced by numerous webs closely spaced about the inner periphery of the trailing end of the cylindrical portion 88. These variations being provided in order to achieve a substantially uniform enhanced sealing engagement of the trailing end 86 of projectiles 84 with the barrel 12.

In the embodiments illustrated in FIGS. 16 and 17, sealing of the projectile in the barrel is at least partially effected by the relatively long cylindrical extension 30, 88 being closely accommodated within the bore of the supporting barrel 11. Additionally, in the case of the FIG. 17 embodiment, sealing is further assisted by the radial expansion of the trailing end 86 into enhanced sealing engagement with the supporting barrel. Furthermore the projectiles 14, 84 may each carry their own supply of propellant 16 to facilitate convenient loading of a barrel 12. Extra propellant may be accommodated in the space between and about the nose of the projectiles if desired.

It will of course be realised that the above has been given only by way of illustrative example of the invention, and that all such modifications and variations thereto as would be apparent to persons skilled in the art are deemed to fall within the broad ambit and scope of the invention as is herein set forth in the accompanying claims.

What is claimed:

1. A projectile for a barrel, comprising a nose;

an expandable tail, wherein when the projectile is stacked nose to tail in a barrel with other projectiles and force is exerted down the barrel, the tail contacts the nose of a trailing projectile and part of the tail of the projectile is thereby expanded into contact with the bore of the barrel; and a propellant charge within the tail for propelling the projectile, the propellant charge being ignitable by a means for electrically igniting disposed at a leading end of the propellant charge.

2. A projectile according to claim 1 wherein the tail comprises an end portion having a concave shape which is complementary to the shape of the nose.

3. A projectile according to claim 1, wherein the tail includes a cylindrical extension rearwards from the nose and a rearmost part of the extension is expanded radially into contact with the bore of the barrel.

4. A projectile according to claim 3, wherein the cylindrical extension is structurally reinforced to limit the radial expansion.

5. A projectile according to claim 1, wherein the tail comprises a cylindrical extension which is integral with the nose.

6. A projectile according to claim 1, wherein the tail comprises a cylindrical extension which fits closely within the bore of the barrel.

7. A projectile according to claim 1, further comprising a spacer which limits compression of the projectiles in the barrel.

8. A projectile according to claim 7, wherein the spacer is a spine extending rearwards from the nose.

9. A projectile according to claim 1, wherein the projectile has a dart-like configuration.

10. A projectile according to claim 1, wherein the tail of the projectile is expanded into sealing contact with the bore of the barrel when force is exerted on the projectile due to firing of a leading projectile.

11. A projectile according to claim 1, wherein each projectile includes reinforcement which limits expansion of the tail.

12. A projectile according to claim 1, wherein each projectile includes a stop which limits expansion of the tail.

13. A projectile according to claim 1, further comprising a printed circuit laminate for providing an electrical ignition pulse to the means for electrically igniting.

14. A projectile according to claim 1, wherein the tail of the projectile is expanded into contact with the bore of the barrel when force is exerted on the projectile during loading.

15. A projectile according to claim 14, wherein the tail of the projectile is expanded into increased contact with the bore of the barrel when force is exerted on the projectile due to firing of a leading projectile.

* * * * *